US006964140B2

(12) United States Patent
Walker et al.

(10) Patent No.: US 6,964,140 B2
(45) Date of Patent: Nov. 15, 2005

(54) STRUCTURAL METAL MEMBER FOR USE IN A ROOF TRUSS OR A FLOOR JOIST

(76) Inventors: Steven H. Walker, 906 Oakdale St., Windermere, FL (US) 34786; Raymond C. Frobosilo, 253 Blackheath Rd., Lido Beach, NY (US) 11561

( * ) Notice: Subject to any disclaimer, the term of this patent is extended or adjusted under 35 U.S.C. 154(b) by 846 days.

(21) Appl. No.: 09/896,505

(22) Filed: Jun. 29, 2001

(65) Prior Publication Data

US 2002/0020138 A1 Feb. 21, 2002

Related U.S. Application Data

(60) Provisional application No. 60/216,509, filed on Jul. 3, 2000.

(51) Int. Cl.[7] ..... E04C 2/38
(52) U.S. Cl. ..... 52/715; 52/729.5; 52/731.7; 52/737.6
(58) Field of Search ..... 52/729.5, 731.2, 52/731.7, 732.1, 737.6, 730.4, 715

(56) References Cited

U.S. PATENT DOCUMENTS 4,435,940 A 3/1984 Davenport et al.
4,748,784 A 6/1988 Dividoff et al.
4,982,545 A 1/1991 Stromback
4,986,051 A * 1/1991 Meyer et al. ..... 52/693
5,417,028 A 5/1995 Meyer
5,463,837 A * 11/1995 Dry ..... 52/634
5,535,569 A * 7/1996 Seccombe et al. ..... 52/634
5,771,653 A * 6/1998 Dolati et al. ..... 52/545
5,865,008 A 2/1999 Larson
6,073,414 A * 6/2000 Garris et al. ..... 52/694
6,088,988 A 7/2000 Sahramaa

* cited by examiner

*Primary Examiner*—Basil Katcheves
(74) *Attorney, Agent, or Firm*—Clifford G. Frayne

(57) ABSTRACT

A cold formed, sheet metal structural member having a first planar web member with two longitudinally extending legs such that the structural member or chord comprises an elongated member of substantially U-shaped cross section being longitudinally symmetric and being closed at one end and open at the other end. The legs are mirror images of each other and terminate with outwardly extending hollow flanges having a margin area juxtaposed to the leg. The bracing web members are slidably receivable within the U-shaped cross section and can be secured to the depending legs by suitable fasteners. A secondary web is positionable on the structural member in parallel relationship to the first web to provide additional resistance for sheathing fasteners.

6 Claims, 3 Drawing Sheets

STRUCTURAL METAL MEMBER FOR USE IN A ROOF TRUSS OR A FLOOR JOIST

This application claims the benefit of provisional application 60/216,509, filed Jul. 3, 2000.

BACKGROUND OF THE INVENTION

1. Field of the Invention

The present invention relates to a structural metal member of substantially U-shaped cross section which can be used in a roof truss or in a floor joist.

2. Description of the Prior Art

The majority of residential house framing is accomplished with wood. Most roofing systems enjoy systems with respect to residential housing have in the past been fabricated and constructed of wooden beams and triangulated cross members. Wood is the material of choice because of cost considerations.

With the increased prices in wood, attention has been given to fabricating roof and flooring systems and indeed the entire structure of a residence out of metal structural members. Heretofore metal structural members could not compete with the cost of conventional wooden structures, but that is changing such that metal can now compete cost wise with wood.

Most structural members are cold formed from sheet metal by rolling, folding or pressing a metal strip in order to form the structural member having the desired cross section. In forming metal structural members, concern must be given for the shape of the structural member in cross section such that it can be easily fabricated into the floor joist or roof truss with the associated support members or webs. Metal offers several advantages since it is lighter in weight, stronger, fire resistant and termite resistant. When discussing roof trusses, they may take on various shapes. The most encountered shape is defined by two upper chords adjoined at their adjacent ends and sloping downwardly and outwardly and the upper chords are attached to a lower chord to form an overall triangular truss. These trusses are spaced apart at a predetermined distance in order to form the support for a roof. Similarly, a floor joist can be constructed by use of an upper chord and a lower chord in parallel disposition with bracing members provided therebetween. These bracing members whether found in the groove truss or the floor joist are commonly referred to as webs.

One problem which has developed with respect to the use of metal structural members for roof trusses or floor joists is that typically, the surface to which the outside sheathing or the floor would be secured to the truss or joist would present the contractor with only a single layered surface for penetration of the fastening means. When fastening a wooden sheathing member to a wooden truss, the fastener, most commonly a nail, penetrates not only the sheathing, but into the roof truss itself such that the nail is frictionally engaged along its entire length. Metal trusses and floor joists which have only a single layer adjacent to the sheathing or floor would allow the nail to be frictionally secured through the sheathing or floor material, and only the single layer of the metal truss or floor joist.

Applicant's invention addresses the overall shape of the chord utilized in the floor joist or the roof truss and also the problem associated with the securing means.

OBJECTS OF THE INVENTION

An object of the present invention is to provide for a novel metal structural member easily fabricated from cold form sheet metal.

Another object of the present invention is to provide for a novel metal structural member which presents a double walled load flange for acceptance of sheathing fasteners.

A still further object of the present invention is to provide for a novel metal structural member which provides superior load bearing performance.

A still further object of the present invention is to provide for a novel metal structural member which can be utilized in a roof truss.

A still further object of the present invention is to provide for a novel metal structural member which can be utilized in a floor joist.

SUMMARY OF THE INVENTION

A cold formed, sheet metal structural member having a first planar web member with two longitudinally extending legs such that the structural member or chord comprises an elongated member of substantially U-shaped cross section being longitudinally symmetric and being closed at one end and open at the other end. The legs are mirror images of each other and terminate with outwardly extending hollow flanges having a margin area juxtaposed to the leg. The bracing web members are slidably receivable within the U-shaped cross section and can be secured to the depending legs by suitable fasteners. A secondary web is positionable on the structural member in parallel relationship to the first web to provide additional resistance for sheathing fasteners.

BRIEF DESCRIPTION OF THE DRAWINGS

These and other objects of the present invention will become apparent, particularly when taken in light of the following drawings wherein.

DETAILED DESCRIPTION OF THE DRAWINGS

Figure 1:
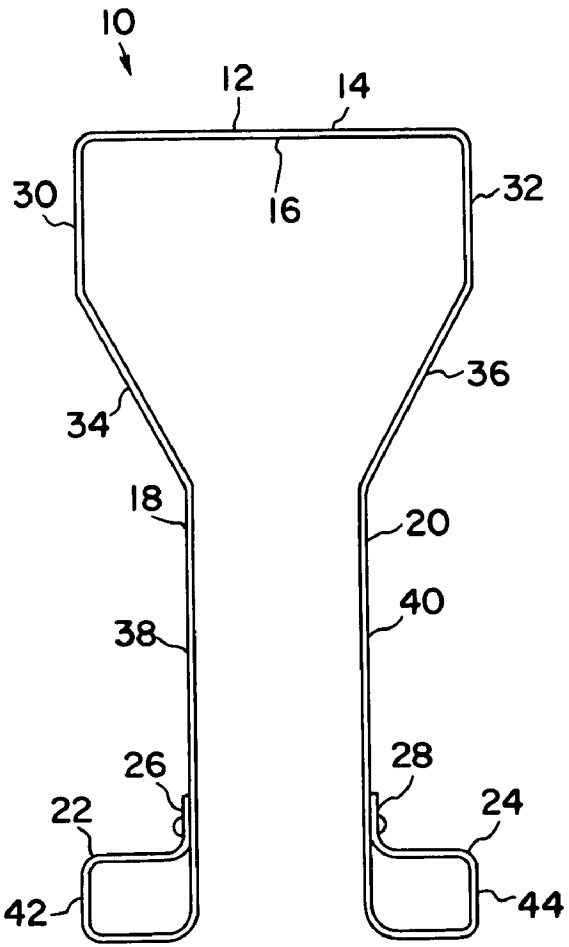
FIG. 1 is a cross section view of the basic structural member of the present invention.

FIG. 1 is a cross section or end view of the structural member 10 which would be in elongate form and comprise a portion of a roof truss or a floor joist. The structural member is generally U-shaped having a web 12 having an upper surface 14 and a lower surface 16. Depending from the lower surface 16 are a pair of legs 18 and 20 which are mirror images of each other and which terminate in an outwardly extending hollow flange 22 and 24 the end margins 26 and 28 of which are juxtaposed to their respective legs.

In the illustration disclosed in FIG. 1, the legs 18 and 20 at first depend perpendicularly 30 and 32 from the lower surface 16 of web 12 and then angle toward each other for a distance 34 and 36 before resuming a perpendicular dependency 38 and 40 from web 12 culminating in the outwardly extending hollow flanges 22 and 24.

The structural member of FIG. 1 can be made of any appropriate metallic material such as aluminum or other metals or metal alloys and would be formed or shaped by a rolling process well-known in the art which would subject a planar longitudinal piece of aluminum or appropriate metal to a series of dies in order to form the shape illustrated in FIG. 1.

The outer walls 42 and 44 of the hollow flange members 22 and 24 are preferably in a plane with the initial perpendicular portion 30 and 32 of legs 18 and 20 in order to facilitate the assembly of a truss or floor joist with the respective cross members. The ends of these cross members would be slidably receivable within the U-shaped channel of structural member 10 and a similar structural member oriented in opposing relationship such that a fastener means (not shown) could be secured through the secondary perpendicular portions 38 and 40 of legs 18 and 20. A roof truss or a floor joist could be similarly assembled. The sheathing of a floor or of a roof would then be secured to the assembled truss by means of a fastening means penetrating the sheathing and the web 12.

Figure 2:
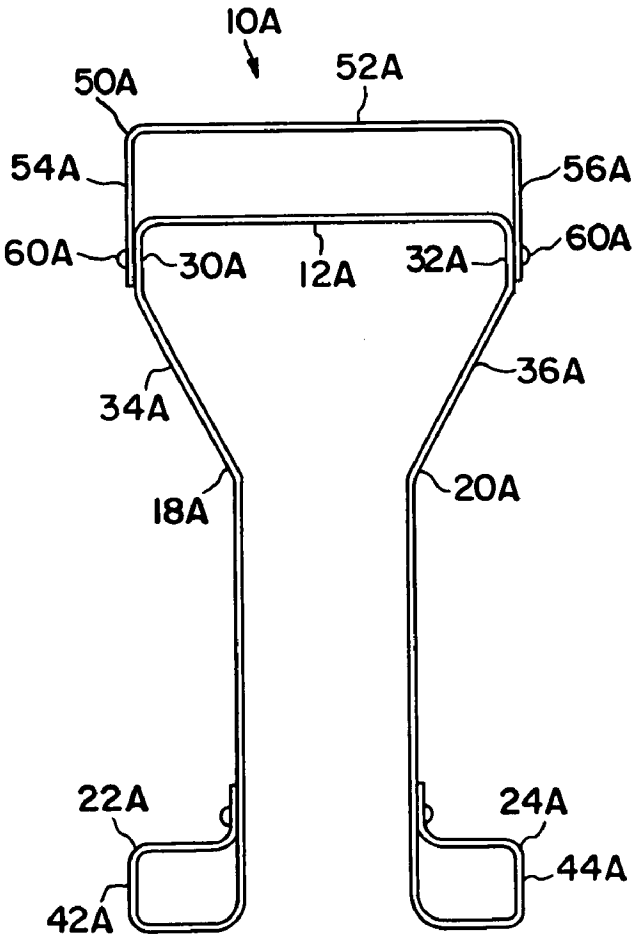
FIGS. 2–7 are cross sectional views of the structural member illustrating variations on the double walled web.
Figure 4:
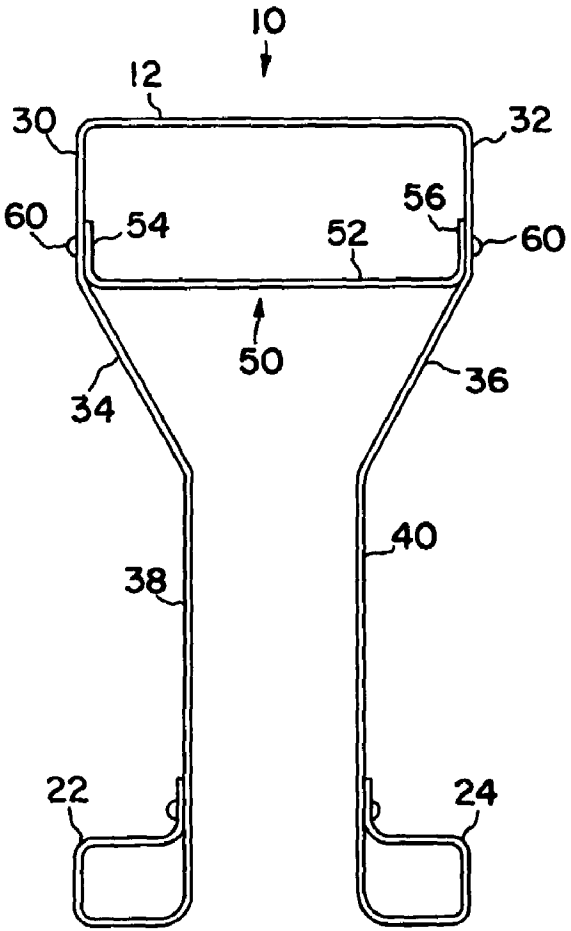
Figure 3:
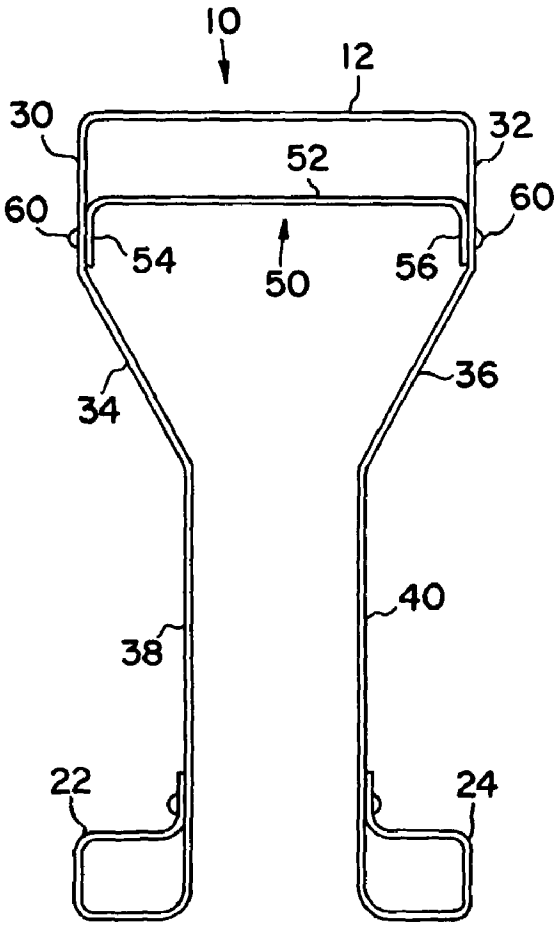

FIG. 1 illustrates a novel structural member for use in the assembly of a roof truss or floor joist. However, it only has a single web 12 for receipt of the fastener for the exterior sheathing or floor material. Thus while the shape of the structural member of FIG. 1 is novel, it does not address the problem of effectuating the securing of the fastening means for the sheathing material. FIGS. 2, 3 and 4 illustrate the structural member of FIG. 1 with an adaptive member which provides for the double walled web for improved engagement with the sheathing fastening means.

FIG. 3 illustrates the structural member of FIG. 1 with a second longitudinal web member 50 positioned approximate to web 14. In FIG. 3, the second web member 50 comprises a web 52 and two depending longitudinal flanges or legs 54 and 56. Second web member 50 is positioned longitudinally within structural member 10 such that the depending longitudinal flanges or legs 54 and 56 are proximately positioned at the angle formed in legs 18 and 20 of structural member 10 and web 52 is positioned in parallel relationship with web 12 of structural member 10.

FIG. 4 illustrates the structural member of FIG. 1 with the second web member as illustrated in FIG. 3, but with the second web member 50 of FIG. 3 reversed such that web 52 of second web member 50 is longitudinally positioned within structural member 10 such that the web 52 is proximate to the angle formed in legs 18 and 20 of structural member 10. In this configuration, the flange or leg portion 54 and 56 extend upwardly towards web 12 of structural member 10. In either embodiment illustrated in FIG. 3 or 4, the second web member 50 may be maintained in position by a plurality of clinches 60 applied where the flange or leg portions 54 and 56 of second web member 50 are juxtaposed against the inner wall of leg members 18 and 20 of structural member 10 or by any other suitable fastening means. In either configuration, the structural member now has an effective double walled web such that a fastener penetrating the sheathing which overlays the structural member will now have two points of penetration or friction contact, namely the web 12 of structural member 10 and the web 52 of second web member 50.

FIG. 2 illustrates an additional embodiment of the structural member and is identified as 10A. This embodiment is similar to that illustrated in FIG. 1 and reference numerals are utilized with the suffix A attached thereto to denote this embodiment in FIG. 2. In this embodiment the first vertical portions 30A and 32A of legs 18A and 20A are shorter than that illustrated in FIG. 1 and web 12A of the structural member 10A forms the inner web member. A second web member 50A having a longitudinal web 52A and depending legs or flanges 54A and 56A is secured to structural member 10A by means of clinches or welds 60A or the like along the longitudinal surfaces where the leg or flange portions 54A and 56A of second web member 50A are juxtaposed against the leg portions 30A and 32A of legs 18A and 20A. The second web member 50A and its web 52A form the upper wall for a double walled structural member. The fastener means utilized to secure the sheathing would then have two contact points with the structural member for improved engagement. The dimensions of the embodiment illustrated in FIG. 2 would be such that the outer walls 42A and 44A of hollow flange members 22A and 24A would be in planar alignment with the legs or flanges 54A and 56A of second web member 50A.

Figure 5:
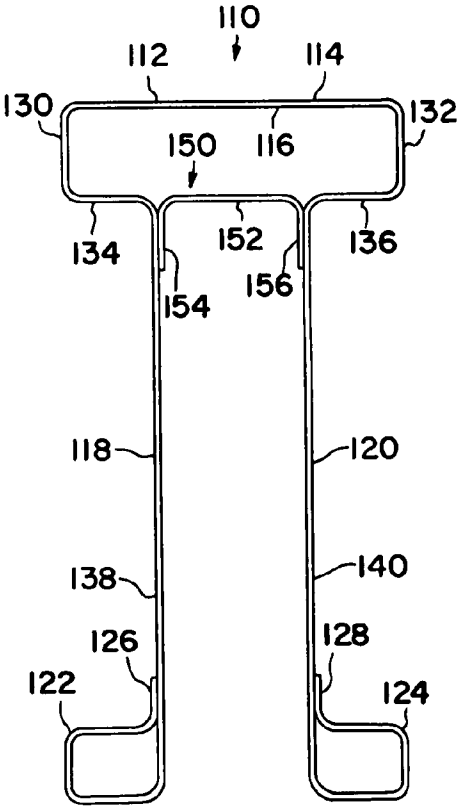
Figure 7:
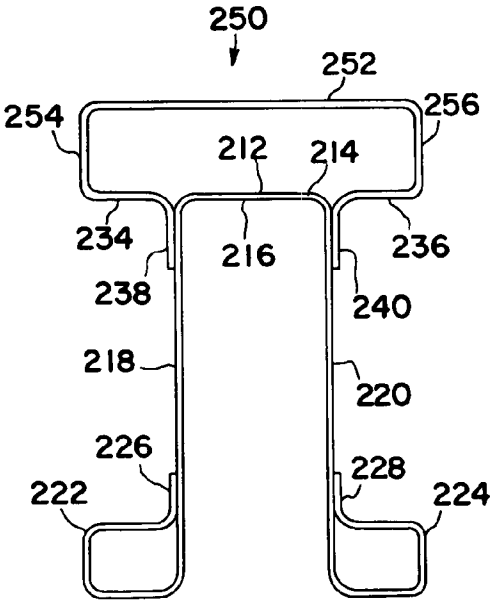
Figure 6:
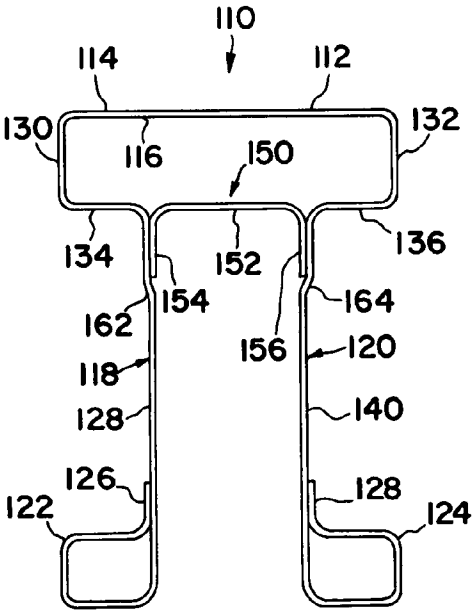

FIGS. 5, 6, and 7 illustrate another embodiment of the structural member of the present invention. FIG. 5 is an end or cross sectional view of a structural member 110. The structural member 110 comprises a web member 112 having an upper surface 114 and a lower surface 116. A pair of legs 118 and 120 depend from web member 112 and terminate in hollow flange members 122 and 124 which in turn terminate in margins 126 and 128 which are affixed to the outer surface of the leg members 118 and 120. The leg members 118 and 120 of the embodiment illustrated in FIG. 5 depend perpendicular from web 112 first distance 130 and 132 respectively, and then are bent or shaped inwardly parallel to web 112 at 134 and 136 and then continue perpendicularly 138 and 140 before terminating in hollow flange members 122 and 124 which include margins 126 and 128 juxtaposed leg members 118 and 120.

A second web member 150 having a longitudinal web 152 and depending flanges or legs 154 and 156 is positioned within the U-shaped cavity of structural member 110 such that its web portion is planar with the parallel leg portions 134 and 136 of legs 118 and 120. In this configuration of the structural member, web 112 forms the outer wall of the double walled structure and the second web member 150 in cooperation with the leg portions 134 and 136 form the inner wall portion of the double walled structural member for receipt of a fastening means. Second web member 150 would be secured to structural member 110 by a plurality of clinches or other suitable fastening means along the leg portion 138 and 140 where the legs or flanges 154 and 156 of second web member 150 are juxtaposed.

FIG. 6 is similar to FIG. 5 with respect to the structural member and the second web member with the exception that the leg portions 138 and 140 are angled inwardly slightly at 162 and 164 along their longitudinal length so as to provide additional support for second web member 150 by engaging the lower ends of leg or flange portions 154 and 156.

FIG. 7 illustrates another embodiment of the structural member of the present invention identified generally as 210. In this embodiment, the basic structural member 210 comprises a web 212 having an upper surface 214 and the lower surface 216. There depends from web 212, a pair of legs 218 and 220 which depend perpendicularly and terminate in hollow flanges 222 and 224 each having a margin 226 and 228 juxtaposed to the outer surface of legs 218 and 220. There is affixed to structural member 210 a second web member 250 which comprises a second web 252, depending legs 254 and 256 which depend perpendicular from web 252 and which then are bent or angled inwardly parallel to web 252 at 234 and 236 respectively and then bent downwardly perpendicular to web 212 at 238 and 240. The distance between leg members 238 and 240 allow second web member 250 to be slidably engaged over structural member 210 such that the leg portions 238 and 240 juxtaposed against leg portions 218 and 220 can be secured by a suitable fastening means and thus present a double walled structural member for receipt of a fastening means utilized to secure the sheathing to the structural member. Again, the fastening means would have two points of contact with the structural member, the first wall being the second web 252 and the inner wall or second wall comprised of the web portion 212 of structural member 210 and the parallel portions 234 and 236 of second web member 250. The margins 126 and 128 and 226 and 228 may be secured along their longitudinal length by a plurality of clinches or other suitable fastening means.

In addition to the foregoing, the outwardly extending hollow flanges also present a double walled fastening means for sheathing or bracing which might be secured to the truss or joist in that location. Still further, while the outwardly extending hollow flanges are depicted in the drawings in a generally rectangular shape, they could also be formed in any similar geometric shape which would present a double wall for a fastening means.

While the present invention has been described with respect to the exemplary embodiments thereof, it will be recognized by those of ordinary skill in the art that many changes and modifications can be made without departing from the spirit and scope of the invention. It is therefore manifestly intended that the invention be limited only by the scope of the claims and the equivalents thereof.

We claim:

1. An elongate metallic structural member having an elongate, planar web surface having longitudinal edges; a first leg member and a second leg member depending to one side of said web member from said longitudinal edges, said first leg member and said second leg member being mirror images, said first leg member and said second leg member terminating with outwardly extending hollow flanges, each of said outwardly extending hollow flanges are defined by said leg member, a first flange side member in a plane parallel with said web member, a second flange side member in a plane parallel with said leg member, and a third flange side member parallel to said first flange side member and said web member, said third flange side member terminating with a margin member juxtaposed to said leg member; said elongate metallic structural member formed with a second web member having an elongate planar web having longitudinal edges and having flange members depending to one side from said longitudinal edges said second web member positioned in substantially parallel relationship to said web surface.

2. The elongate metallic structural member in accordance with claim 1 wherein said second web member is secured between said leg members.

3. The elongate metallic structural member in accordance with claim 1 wherein said second web member is positioned above said web surface, said flanges of said second web member being secured to said leg members of said elongate metallic structural member.

4. The elongate metallic structural member in accordance with claim 3 wherein said second flange side member of said hollow flanges is in the plane of said flanges of said second web member.

5. The elongate metallic structural member in accordance with claim 1 wherein said leg members depend perpendicularly from one side of said web surface for a distance and transition angularly towards opposing leg member for a distance and transition perpendicularly to said web member terminating in said outwardly hollow extending flanges.

6. The elongate metallic structural member in accordance with claim 5 wherein a second web member is disposed between said leg members where said leg members transition angularly from the perpendicular.

* * * * *